United States Patent [19]

Osada

[11] Patent Number: 4,884,657

[45] Date of Patent: Dec. 5, 1989

[54] MUFFLER

[75] Inventor: Hiroshi Osada, Yokohama, Japan

[73] Assignee: Nifco, Inc., Yokohama, Japan

[21] Appl. No.: 311,248

[22] Filed: Feb. 16, 1989

[30] Foreign Application Priority Data

Feb. 29, 1988 [JP] Japan ..... 63-26645[U]

[51] Int. Cl.[4] ..... F01N 1/10; F01N 7/18

[52] U.S. Cl. ..... 181/258; 181/239; 181/243; 181/269; 181/282

[58] Field of Search ..... 181/230, 243, 249, 252, 181/255, 257, 258, 272, 239, 269, 282

[56] References Cited

U.S. PATENT DOCUMENTS 3,380,553 4/1968 Gibel ..... 181/230

3,567,338 2/1971 Rader ..... 181/243

4,316,523 2/1982 Boretti ..... 181/258 X 4,421,202 12/1983 Hoy ..... 181/252

*Primary Examiner*—B. R. Fuller

*Attorney, Agent, or Firm*—Schwartz & Weinrieb

[57] ABSTRACT

A muffler includes a cylindrical body, a gas passage pipe insertedly mounted within the cylindrical body, and a sound absorber mounted upon the gas passage pipe in an encircling manner. Gas is discharged from the gas passage pipe through the cylindrical body and sound absorber. The cylindrical body has a disk-like partitioning wall axially dividing the interior space thereof. The gas passage pipe has an outer flange and a plurality of pawls cooperating with the flange so as to clamp the partitioning wall therebetween.

20 Claims, 3 Drawing Sheets

MUFFLER

FIELD OF THE INVENTION

This invention relates to a muffler which is disposed within an exhaust gas passage of an engine or the like.

DESCRIPTION OF THE PRIOR ART

A muffler is disposed within an exhaust gas passage of, for example, an automobile engine or the like for receiving, and in effect, environmentally treating blow-by gas or the like exhausted from the automobile engine, whereby the blow-by gas or the like is then subsequently discharged toward the atmosphere or the like through the muffler.

In this type of muffler, a gas passage pipe with a sound absorber mounted thereon is insertedly mounted within a cylindrical body, and the blow-by gas or the like is passed through the gas passage pipe and sound absorber so as to be discharged externally of the cylindrical body, thereby reducing the sound produced when the blow-by gas or the like is discharged.

In this type of muffler, as shown in FIG. 4, the gas passage pipe 12 with a sintered body 10 mounted thereon as a sound absorber is mounted within the cylindrical body 14 by threadedly engaging a bolt 18 with a nut 16 which is secured to the gas passage pipe 12 at the time of formation of the pipe 12. Since the nut 16 and bolt 18 are provided as separate components, they increase the number of components of the muffler and hence increase the manufacturing cost thereof.

OBJECT OF THE INVENTION

An object of the invention is to provide a muffler in which a gas passage pipe can be readily mounted within a cylindrical body without the use of any mounting numbers, as for example a bolt or a nut.

SUMMARY OF THE INVENTION

To attain the above object of the invention, there is provided a muffler, which comprises a cylindrical body, a gas passage pipe insertedly mounted within the cylindrical body, and a sound absorber mounted upon the gas passage pipe, gas being discharged from the gas passage pipe through the cylindrical body and sound absorber, the cylindrical body having a disk-like partitioning wall axially dividing the interior space thereof, and the gas passage pipe is provided with an outer flange for engaging and seating upon the upper surface of the partitioning wall and a plurality of pawls engaging an undersurface portion of the partitioning wall for clamping the gas passage pipe to the partitioning wall.

The muffler having the above construction can be readily assembled by inserting the gas passage pipe into the cylindrical body, thereby causing the disk-like partitioning wall of the body to be clamped by means of the flange and pawls of the gas passage pipe.

BRIEF DESCRIPTION OF THE DRAWINGS

The above and other objects and features of the invention will become more apparent from the following detailed description with reference to the accompanying drawings, in which like reference characters designate like or corresponding parts throughout the several views, and wherein.

DETAILED DESCRIPTION OF THE PREFERRED EMBODIMENT

Figure 1:
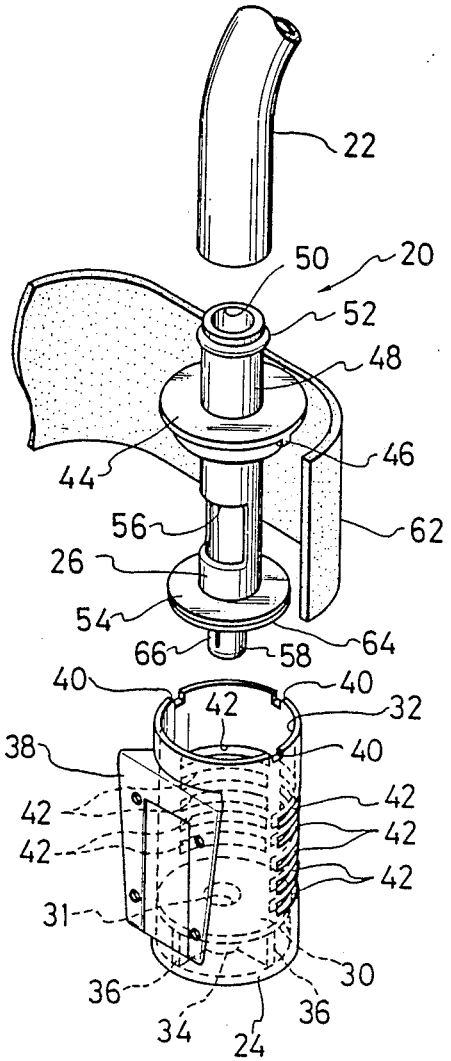
FIG. 1 is an exploded perspective view showing an embodiment of the muffler according to the invention.
Figure 2:
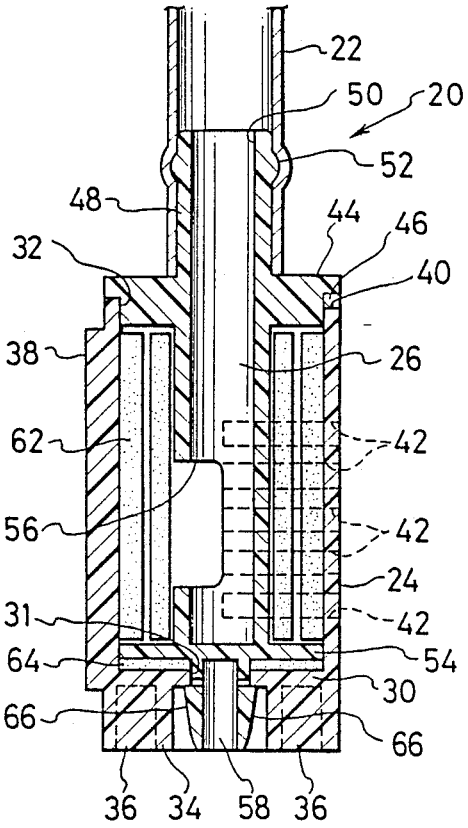
FIG. 2 is a sectional view showing the muffler shown in FIG. 1 in an assembled state.
Figure 3:
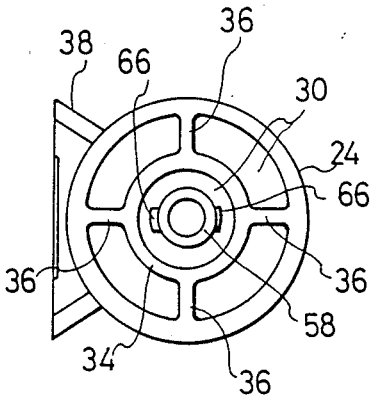
FIG. 3 is a bottom view showing the muffler shown in FIG. 2.
Figure 4:
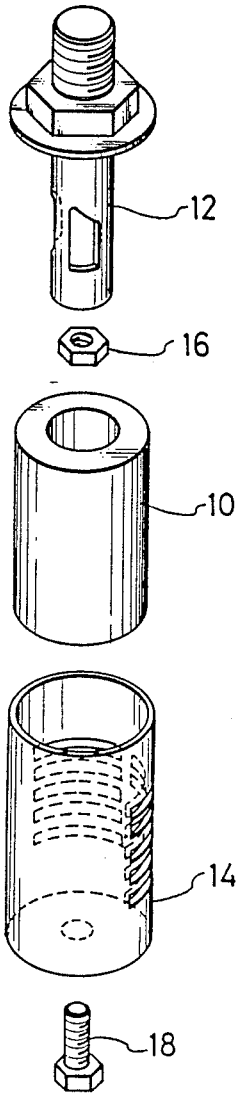
FIG. 4 PRIOR ART
FIG. 4 is an exploded perspective view showing a prior art muffler.

FIGS. 1 to 3 show an embodiment of the muffler 20 according to the invention. To the muffler 20 there is connected an exhaust pipe 22, as shown in FIG. 2, through which blow-by gas from an engine (not shown) is introduced into the muffler 20. As shown in FIG. 1, the muffler 20 comprises a cylindrical body 24 and a gas passage pipe 26. The gas passage pipe 26 is insertedly accommodated within the cylindrical body 24 as shown in FIG. 2.

As shown in FIGS. 1 and 3, the cylindrical body 24 is substantially cylindrical and has a disk-like partitioning wall 30 provided near one end ther in the axial direction and therefore dividing the interior thereof into a smaller inner space below the wall 30 and a larger inner space above the wall 30 as best seen in FIG. 2. The gas passage pipe 26 is inserted into the cylindrical body 24 through the open end 32 thereof which is remote from the partitioning wall 30. The partitioning wall 30 has a central through hole 31, through which a lower portion 58 of the gas passage pipe 26 is inserted. The partitioning wall 30 is reinforced with integral cylindrical and radial ribs 34 and 36 extending from the undersurface of wall 30 to the end of body 24 which is disposed opposite the open end 32.

The outer periphery of the cylindrical body 24 is provided with a block-like projection 38 upon a first sidewall portion thereof, notches 40 formed within the upper peripheral edge portion 32 thereof, and gas passage slots 42 within other sidewall portions thereof. The block-like projection 38 projects outwardly from the outer periphery of the cylindrical body 24 and has a flat outer surface. The muffler may therefore be secured to an automobile body by securing the flat surface to an automobile panel by means of bolts, not shown. There are three notches 40. They are formed at the open end 32 of the cylindrical body 24 and are circumferentially uniformly spaced apart. The gas passage pipe 26 has projections 46 as will be described later, which are fitted within the notches 40. The gas passage slots 42 fluidically communicate the inside of the body 24 with the outside of the cylindrical body 24 and constitute outlets through which blow-by gas or the like is discharged from the body 24 to the outside thereof. As shown most clearly in FIG. 1, the gas passage slots 42 are formed within two rows in a portion of the peripheral wall diametrically opposite the block-like projection 38, each row extending axially and consisting of a plurality of slots 30.

As shown in FIG. 1, the gas passage pipe 26 has a disk-like cap 44 formed at an axially intermediate position thereof. A portion of the gas passage pipe on one side of the cap 44 is inserted into the cylindrical body 24, and the other end portion projects outwardly projects from the body 24 as best seen in FIG. 2.

The cap 44 engages with and closes the open end 32 of the cylindrical body 24 and serves as a lid for the open end 32. The periphery of the cap 44 is formed with the projections 46, as shown in FIG. 1, which fit within the notches 40 of the cylindrical body 24 so as to properly orient or position the gas passage pipe 26 in the circumferential direction. In this embodiment, three projections 46 are provided in correspondence with the three notches 40 of the cylindrical body 24 (only one of these projections 46 being shown in FIGS. 1 and 2), and serve to properly orient or position the gas passage pipe 26 with respect to the cylindrical body 24 in the circumferential direction.

The portion of the gas passage pipe 26 projecting outwardly from the cap 44 serves as a mounting section 48 upon which the exhaust pipe 22 is mounted, and the free open end thereof serves as a gas inlet 50 for blow-by gas. As shown in FIG. 1, the mounting section 48 has an integral ring-like portion 52 provided near the free end thereof and serves as a retainer for the exhaust pipe 22.

The portion of the gas passage pipe 26 which is disposed upon the side of the cap 44 opposite the mounting section 48 has an integral flange 54 formed at an intermediate portion thereof. An outlet 56 is formed within a sidewall portion of pipe 26 upon the side of the flange 54 nearer the cap 44 and the small-diameter cylindrical end portion 58 is formed upon the other side thereof.

The flange 54 is located closer to the open end 32 of the cylindrical body 24 than the partitioning wall 30 when the muffler is disposed in its assembled condition or state as seen in FIG. 2. It is close to and parallel to the partitioning wall 30. The flange 54 closes the lower end of the passage of the gas passage pipe 26. Blow-by gas is therefore discharged from the gas passage pipe 26 through means of the outlet 56 into the cylindrical body 24.

As shown in FIG. 1, the outlet 56 is formed by removing a substantially semi-circular portion of the gas passage pipe 26. It communicates the inside of the pipe with the outside of the gas passage pipe 26, and blow-by gas is discharged from the gas passage 26 into the cylindrical body 24 through the outlet 56. This outlet 56 faces a peripheral wall portion of the cylindrical body 24 diametrically opposite the gas passage slots 42. A belt-like heat-resistant sponge member 62 is wound as a sound absorber, substantially as two radially spaced circumferential layers, upon the gas passage pipe 26 and encircling the outlet 56, so that blow-by gas is discharged from the outlet 56 and through the sponge member 62 into the cylindrical body 24.

The small-diameter cylindrical end portion 58 of pipe 26 is inserted through the hole 31 of the partitioning wall 30, a packing 64 is fitted upon the undersurface of flange 54, and it has pawls 66.

The packing 64 is disposed about the small-diameter cylindrical end portion 58 near a stem portion thereof. It intervenes between the flange 54 and the partitioning wall 30 and prevents blow-by gas from flowing from the inside of the cylindrical body 24 and through the hole 31 to the outside of the muffler.

The pawls 66 are formed by raising portions of the outer periphery of the small-diameter cylindrical end portion 58 and cooperate with the flange 54 so as to clamp the partitioning wall 30 therebetween and prevent detachment of the gas passage pipe 26 from body 24. The pawls 66 are cantilever cantilevered portions extending axially along the small-diameter cylindrical end portion 58 as shown in FIGS. 1 and 2. As the small-diameter cylindrical end portion 58 of pipe 26 is inserted through the hole 31 of partitioning plate 30, the pawls 66 are elastically deformed. When they clear the hole 31, they restore to their original state so as to clamp the partitioning wall 30 in cooperation with the flange 54.

Now, the procedure of assembling the muffler 20 will be described.

First, the packing 64 and sponge member 62 are mounted upon the gas passage pipe 26. The packing 64 is mounted from the free end of the small-diameter cylindrical portion 58 and is mounted upon the stem portion of the portion 58. The sponge member 62 is wound for substantially two turns upon the portion of the gas passage pipe 26 defined between the cap 44 and the flange 54.

Subsequently, the gas passage pipe 26 is positioned with respect to the cylindrical body 24 and is inserted into the body 24 through the open end 32 thereof with its free end disposed first. The insertion is continued until the projections 46 are fitted within the notches 40 of the body 24.

When the gas passage pipe 26 is inserted into the cylindrical body 24 at this stage, it is circumferentially positioned as a result of the disposition of the projections 46 within the notches 40 of the body 24. At this time, the pawls 66 pass through the hole 31 of the partitioning wall 30 so that the partitioning wall 30 is clamped between the flange 54 and the pawls 66. In this way, the muffler 20 is assembled as shown in FIG. 2.

As has been described, in the above embodiment the cylindrical body 24 is formed with the partitioning wall 30 while the gas passage pipe 26 is formed with the flange 54 and pawls 66 for clamping the partitioning wall 30 therebetween, so that it is possible to easily mount the gas passage pipe 26 upon the cylindrical body 24 so as to facilitate the assembly work. In addition, no particular mounting member such as, for example, a bolt or a nut is necessary. Thus, compared with the prior art the number of components can be reduced, and the need for the operation during manufacture of securing a nut to the gas passage pipe is eliminated. It is thus possible to manufacture the muffler inexpensively. Furthermore, since a sponge member is used as a sound absorber, the weight and cost are reduced as compared to the case of using a sintered body as in the prior art.

With the muffler 20, the exhaust pipe 22 is connected to the mounting section 48 of the gas passage pipe 26, and the muffler 20 is mounted upon the vehicle by attaching the block-like projection 38 of the cylindrical body 24 to a vehicle panel, not shown. With this mounting arrangement, blow-by gas is introduced from the exhaust pipe 22 through the inlet 50 of pipe 26 so as to be discharged through the outlet 56, sponge member 62 and gas passage slots 42 to the outside of the cylindrical body 24, thus reducing the sound produced at the time of the discharge of the blow-by gases.

As has been described in the foregoing, with the muffler according to the invention, which comprises a cylindrical body, a gas passage pipe insertedly mounted within the cylindrical body and a sound absorber mounted upon the gas passage pipe, gas is discharged from the gas passage pipe through the cylindrical body sound absorber, the cylindrical body having a disk-like partitioning wall axially dividing its interior, the gas passage pipe having an outer flange and a plurality of pawls for clamping the partitioning wall therebetween, it is possible to mount a gas passage pipe within the cylindrical body without the use of any particular mounting member.

Obviously, many modifications and variations of the present invention are possible in light of the above teachings. It is therefore to be understood that within the scope of the appended claims, the present invention may be practiced otherwise than as specifically described herein.

I claim:

1. A muffler, comprising:

a cylindrical body;

a gas passage pipe disposed within said cylindrical body;

a sound absorber mounted upon said gas passage pipe such that gas discharged from said gas passage pipe passes through said cylindrical body and said sound absorber, said cylindrical body having a disk-like partitioning wall axially dividing an interior portion thereof; and said gas passage pipe having an outer flange and a plurality of pawls for clamping said partitioning wall of said cylindrical body therebetween.

2. The muffler according to claim 1, wherein said gas passage pipe includes a cap portion for closing an open end of said cylindrical body.

3. The muffler according to claim 2, wherein said cylindrical body has a plurality of notches formed at said open end thereof, and said cap portion has a plurality of projections formed on a surface in contact with said open end of said cylindrical body and engaged in said notches.

4. The muffler according to claim 1, wherein said sound absorber is a heat-resistant sponge member.

5. A muffler as set forth in claim 1, further comprising:

means formed upon an end portion of said gas passage pipe, remote from said outer flange, for securing an exhaust pipe upon said gas passage pipe so as to conduct exhaust gases from said exhaust pipe into said gas passage pipe.

6. A muffler as set forth in claim 1, wherein:

said sound absorber is disposed about said gas passage pipe in an encircling manner.

7. A muffler as set forth in claim 2, wherein:

said sound absorber is disposed about said gas passage pipe in an encircling manner.

8. A muffler as set forth in claim 7, wherein:

said sound absorber is interposed between said outer flange and said cap portion of said gas passage pipe.

9. A muffler as set forth in claim 1, further comprising:

slot means defined within a peripheral wall portion of said cylindrical body for permitting said gas, passing through said gas passage pipe, said sound absorber, and said cylindrical body, to be discharged exteriorly of said cylindrical body.

10. A muffler as set forth in claim 9, wherein:

said slot means comprises two vertically extending, circumferentially spaced rows of slots.

11. A muffler as set forth in claim 1, further comprising:

block means integrally formed with said cylindrical body for mounting said muffler upon a vehicle panel.

12. A muffler as set forth in claim 9, further comprising:

block means integrally formed with said cylindrical body for mounting said muffler upon a vehicle panel.

13. A muffler as set forth in claim 12, wherein:

said block means is formed upon a peripheral wall portion of said cylindrical body which is diametrically opposite said peripheral wall portion of said cylindrical body within which said slot means is defined.

14. A muffler as set forth in claim 1, further comprising:

exhaust opening means defined within a peripheral wall portion of said gas passage pipe for discharging said gas toward said sound absorber and said cylindrical body.

15. A muffler as set forth in claim 9, further comprising:

exhaust opening means defined within a peripheral wall portion of said gas passage pipe for discharging said gas toward said sound absorber and said cylindrical body.

16. A muffler as set forth in claim 15, wherein:

said exhaust opening means defined within said peripheral wall portion of said gas passage pipe is disposed at a circumferential location within said muffler which is disposed diametrically opposite said slot means of said cylindrical body.

17. A muffler as set forth in claim 1, further comprising:

packing means interposed between said outer flange of said gas passage pipe and said partitioning wall of said cylindrical body for preventing the discharge of said gas out from said cylindrical body within the vicinity of said partitioning wall.

18. A muffler as set forth in claim 17, further comprising:

axially extending stem means integrally formed upon an end portion of said gas passage pipe and upon which said pawls are mounted; and means defining an aperture within said partitioning wall of said cylindrical body through which said stem means and said pawls extend such that said pawls can clampingly engage said partitioning wall of said cylindrical body.

19. A muffler as set forth in claim 18, wherein:

said packing means is an annulus disposed about said stem means of said gas passage pipe.

20. A muffler as set forth in claim 1, further comprising:

axially extending stem means integrally formed upon an end portion of said gas passage pipe and upon which said pawls are mounted; and means defining an aperture within said partitioning wall of said cylindrical body through which said stem means and said pawls extend such that said pawls can clampingly engage said partitioning wall of said cylindrical body.

* * * * *